US006491995B1

(12) United States Patent
Schreiner

(10) Patent No.: US 6,491,995 B1
(45) Date of Patent: Dec. 10, 2002

(54) SELF-ADHESIVE LABEL

(75) Inventor: Helmut Schreiner, Munich (DE)

(73) Assignee: Schreiner Etiketten und Selbetklebetechnik GmbH & Co., Oberschleibhein (DE)

( * ) Notice: Subject to any disclaimer, the term of this patent is extended or adjusted under 35 U.S.C. 154(b) by 0 days.

(21) Appl. No.: 09/475,243

(22) Filed: Dec. 30, 1999

(30) Foreign Application Priority Data

Sep. 20, 1999 (DE) ..... 199 45 030

(51) Int. Cl.[7] ..... G09F 3/00

(52) U.S. Cl. ..... 428/40.1; 283/81; 283/101; 428/41.9; 428/42.1; 428/42.2; 428/42.3; 428/194; 428/201; 428/202

(58) Field of Search ..... 428/40.1, 42.1, 428/42.2, 42.3, 41.9, 194, 201, 202; 283/81, 101

(56) References Cited

U.S. PATENT DOCUMENTS 5,658,632 A * 8/1997 Krabill ..... 428/194
5,989,667 A * 11/1999 Tayebi ..... 428/40.1

FOREIGN PATENT DOCUMENTS

GB 2 093 794 A 9/1982

* cited by examiner

*Primary Examiner*—Nasser Ahmad
(74) *Attorney, Agent, or Firm*—Nixon Peabody LLP; Donald R. Studebaker

(57) ABSTRACT

A self-adhesive label for automatic or manual dispensing comprises an adhesive region and a less-adhesive region on one side with the non-adhesive region being formed such that the adhesive power of the label varies continuously in a transition region between the adhesive and the less-adhesive region.

7 Claims, 1 Drawing Sheet

SELF-ADHESIVE LABEL

BACKGROUND OF THE INVENTION

The invention relates to a self-adhesive label, in particular, to self-adhesive labels for dispensing by machine or for dispensing by hand-operated labelling appliances.

Self-adhesive labels which are dispensed by machine or manually generally have to be removed from a material web provided with an anti-adhesion layer. This separation usually takes place by deflecting the material web over a dispensing edge with a small radius and the label thereby coming away from the material web and being stuck to its designated location. This method frequently entails the problem of some labels, in particular those which have a straight edge transversely to the running direction, being difficult to detach solely by deflecting the material web.

A past proposal for improving the detachment behaviour consisted in modifying the edge of the labels lying in front in the running direction such that their sides lying in front in the running direction are wave-like or oblique. Labels of this kind are known from British Patent 2 093 794. The result of this is to enable the labels to easily come away from the material web when the latter is deflected at the front end in relation to the running direction.

However the known labels have the disadvantage of requiring a certain external shape if their detachment from the material web is to be improved. For example, the known measure cannot help to improve the detachment properties of labels of a rectangular shape or those which, at least in the running direction, have a front edge disposed perpendicularly to the latter.

SUMMARY OF THE INVENTION

The present invention seeks to provide a label of the above-mentioned type which does not have the above disadvantages and which can easily be detached from a material web when dispensed by machine or manually, even when having a straight front edge extending transversely to the dispensing or running direction.

According to the present invention, there is provided a self-adhesive label comprising a base layer, an adhesive layer disposed at least on a part of the base layer, the label having a plurality of borders, the adhesive layer being formed at least at one of said borders whereby there is a reduction in the adhesive power of said adhesive layer in steps or continuously in the direction of said one of said borders.

BRIEF DESCRIPTION OF THE DRAWINGS

Preferred embodiments of the present invention will now be described, by way of example only, with reference to the accompanying drawings, of which.

DESCRIPTION OF THE PREFERRED EMBODIMENTS

Figure 1:
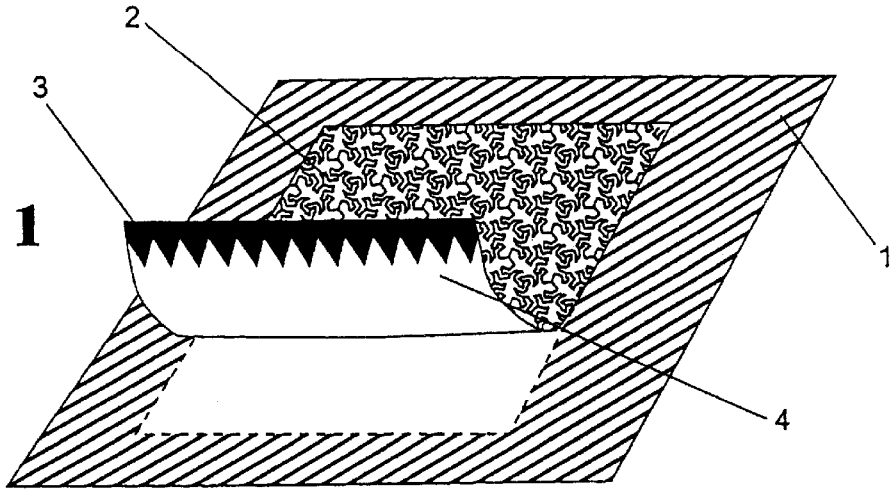
FIG. 1 shows a perspective view of a first embodiment of the label according to the invention.

The present invention provides a self-adhesive label with a base layer and an adhesive layer disposed at least on one side of the base layer, wherein the adhesive layer is formed at least at one border of the label such that the adhesive power decreases in steps or continuously in the direction of this border.

The measure according to the invention surprisingly enables the labels to be detached from a carrier layer with a high level of reliability. Disturbances when dispensing the labels become extremely rare. This is probably due to the prevention of suddenly occurring strong separation forces between the carrier layer and the label which could drag the latter away with the carrier layer. Because of the gradual increase in adhesive power which is achieved with the label according to the invention, starting with a very small adhesive power at the border of the label until the full adhesive power is reached, the bending moments on the self-adhesive label to be detached always remain so small that this cannot follow the carrier layer deflected over the dispensing edge.

According to an advantageous embodiment of the invention, the adhesive power is reduced by providing in the border region non-adhesive or slightly adhesive regions whose area and/or number increase(s) towards the border.

The non-adhesive or slightly adhesive regions are preferably provided at the edge which is at the front in the running direction of the labels and may comprise just one coherent region or a plurality of regions. The boundary of the non-adhesive or slightly adhesive region with respect to the adhesive layer is preferably not a straight line, so that the result is not a boundary, but a transition region containing adhesive and non-adhesive or slightly adhesive regions. The adhesive areas increase in relation to the non-adhesive or slightly adhesive areas in this transition region. Hence the adhesive power of the label also increases continuously in one direction and decreases to the same degree in the other direction. The decrease advantageously takes place in the running direction of the label, so that it can easily come away from a material web, for example, when the latter is deflected when dispensing labels by machine or manually.

The non-adhesive or slightly adhesive region advantageously has a serrated structure. The serrated structure produces a transition region in which the decrease or increase in the adhesive power of the label is particularly uniform, so that the label can come away from its undersurface in an equally uniform manner.

The transition region may have a wavy structure as an alternative or in addition to this. This structure is also of particular advantage, as it enables the label to be detached uniformly in the same way as the serrated structure.

The non-adhesive or slightly adhesive part may extend over the entire border region of the label or just a part. At least the boundary lying in front in the running direction when the label is dispensed advantageously falls within the non-adhesive or slightly adhesive region.

According to a further advantageous embodiment of the invention, the non-adhesive or slightly adhesive region may comprise a pattern of non-adhesive or slightly adhesive strips or stripes of different lengths. The strip pattern is in this case configured so as to create a transition region with a continuous decrease or increase in the adhesive power of the label. The non-adhesive or slightly adhesive region may also comprise a pattern of non-adhesive or slightly adhesive dots which become denser towards the border of the label. A continuous increase or decrease in the adhesion of the label according to the invention is again produced in the transition region through the densification towards the border.

According to a further embodiment of the invention, the reduction in the adhesive power towards the border may also be achieved by using adhesives of differing adhesive power which are provided in a plurality of strips at the border of the label.

According to a further embodiment of the invention, the self-adhesive label is disposed on a carrier layer. The carrier layer is preferably provided with an anti-adhesion layer (for example silicone-treated) and is preferably of a nature such that it can accommodate a plurality of labels. This embodiment may be used as a roller article in existing labelling devices.

Non-adhesive regions or slightly adhesive regions may be produced on the self-adhesive layer by using a film which is coated all over with adhesive and which is printed or coated at the desired points with a material which completely or partly counterbalances the adhesive power. If a varnish or a colouring matter is used for coating, the degree of weakening of the adhesive power may also be adjusted through the thickness of the varnish or colouring matter which is applied.

The invention enables the labels to be of any desired shape. Reliable detachment is possible even when the front edge is oriented perpendicularly to the running direction.

Referring now to the drawings, FIG. 1 is a perspective view of a label according to the present invention. Base layer 2 of the label adheres to a carrier layer 1 by means of an adhesive layer 4. A region 3 is formed so as to be non-adhesive or slightly adhesive at the border of the label. The boundary region between the adhesive and non-adhesive or slightly adhesive region of the label is created such that the adhesive power of the label increases continuously in this transition region. For this purpose the non-adhesive or slightly adhesive region 3 may comprise a serrated pattern. This results in a steady increase in the adhesive power of the label from the border towards the centre in the transition region until it finally reaches a maximum. Any number of serrations may be provided. The more serrations provided, the more homogeneous the adhesion in the transition region. One or more serrations of the same or different size may be provided, according to the desired adhesive power. The choice of non-adhesive or slightly adhesive region is not in this respect restricted to a serrated pattern.

As shown in FIGS. 2*a*–2*d,* the non-adhesive or slightly adhesive region 3 may have different structures which are adapted to create a transition region which results in a continuously varying adhesion of the label. For example, the non-adhesive or slightly adhesive region 3 may have a wave-like structure, as shown in FIG. 2*a.* A structure of this kind also guarantees a steady variation in the adhesive power of the label in the transition region between the adhesive and non-adhesive or slightly adhesive regions.

A further possibility for achieving a variation according to the invention in the adhesive power in the transition region is represented in FIG. 2*b.* For this purpose a pattern of lines or strips of different lengths may be provided on the base layer 2 of the label. The lines or strips may extend longitudinally, transversely or diagonally and may be disposed both regularly and stochastically. It is preferable for the strips to extend in the direction which corresponds to the running direction of the labels when they are dispensed. The longest strips are few in number. The number of strips increases as their length decreases.

In a further variant, as shown in FIG. 2*c,* the non-adhesive or slightly adhesive region 3 is formed as a dot pattern. Here too the dots may be distributed both regularly in the form of a grid and stochastically. In this case the density of the non-adhesive or slightly adhesive dots increases from the centre towards the border, thus producing a transition region with a steadily varying adhesive power.

Figure 2:
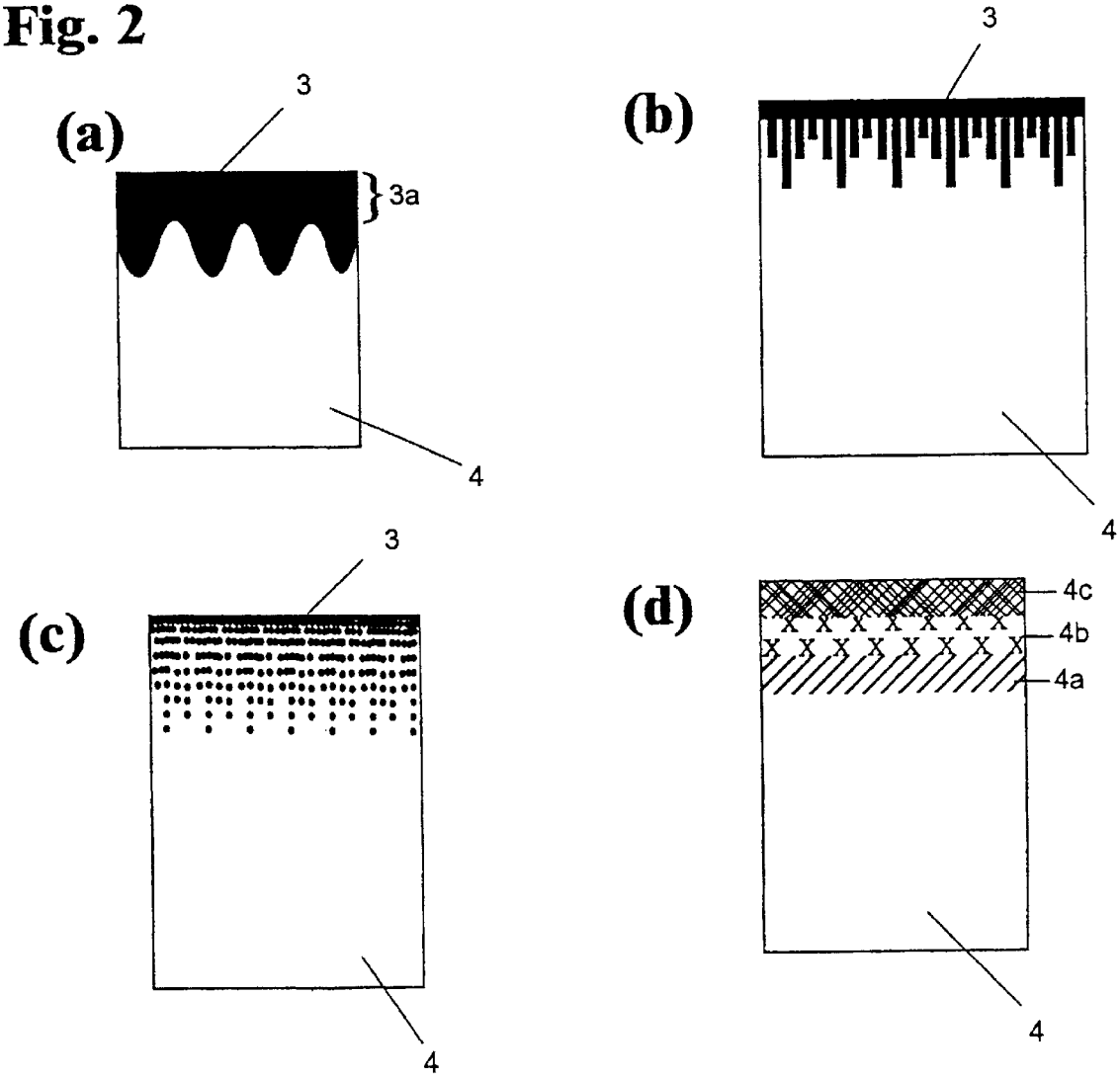
FIGS. 2*a*–2*d* show a plan view of further embodiments of the invention.

FIG. 2(*d*) shows a further variant in which regions with different adhesives are provided at the border of the label. The adhesive power of the adhesives decreases from the region 4 over the regions 4*a, b* and *c.* The differing adhesive power may be achieved by printing the label with different adhesives. However it is also possible to achieve the same structure shown in FIG. 2*d* by applying an agent which reduces the adhesive power to a film coated uniformly with adhesive such that maximum weakening of the adhesive power occurs in the border strip 4*c,* while appropriately smaller quantities of the agent have been applied in the regions 4*b* and 4*a.* A quasi continuous transition may be achieved by providing a plurality of regions.

The non-adhesive or slightly adhesive region may also be formed by other patterns, in particular also combinations of the above-mentioned structures. It is important for the ratio of adhesive areas to non-adhesive or slightly adhesive areas of the label to increase gradually from the non-adhesive or slightly adhesive border of the label and for an abrupt transition to be avoided. Patterns and structures of the mentioned type can be produced relatively easily in existing production plant by firstly covering the underside of a base layer 2 all over with an adhesive layer 4 and then overprinting it with the desired non-adhesive or slightly adhesive structure. It is of course also possible to produce the structures from non-adhesive or slightly adhesive regions by applying adhesive selectively to the underside of the base layer 2 in an appropriate form. The labels thus produced are particularly suitable for automatic dispensing, especially by hand-operated labelling appliances and the like, in which simple detachment of the labels from a rolled-up material web or the like is desirable.

It will be understood that the above description of the present invention is susceptible to various modifications, changes and adaptations.

What is claimed is:

1. A longitudinally extending, anti-adhesive carrier web carrying at least one self-adhesive label being releasably adhered to said carrier web with a non-uniform adhesive strength per unit surface area, said carrier web being adapted to dispense said at least one self-adhesive label when it is advanced in a running direction of said carrier web, said at least one self-adhesive label comprising a base layer, an adhesive layer disposed at least on a part of said base layer and a plurality of edges, one of said edges being a leading edge with respect to said running direction, there being a reduction in said adhesive strength per unit surface area of said adhesive layer in a direction toward said leading edge.

2. A longitudinally extending, anti-adhesive carrier web carrying at least one self-adhesive label being releasably adhered to said carrier web with an adhesive strength, said carrier web being adapted to dispense said at least one self-adhesive label when it is advanced in a running direction of said carrier web, said at least one self-adhesive label comprising a base layer, an adhesive layer disposed at least on a part of said base layer and a plurality of edges, one of said edges being a leading edge with respect to said running direction, there being a reduction in said adhesive strength of said adhesive layer in a direction toward said leading edge, wherein said reduction is achieved by providing a number of adhesive regions of reduced adhesive strength each having an area in a vicinity of said leading edge whereby at least one of the areas and a number of said adhesive regions increase towards said leading edge.

3. The carrier web according to claim 2, wherein said regions of reduced adhesive strength form a serrated structure.

4. The carrier web according to claim 2, wherein said regions of reduced adhesive strength form a wavy structure.

5. The carrier web according to claim 2, wherein said regions of reduced adhesive strength form a pattern of strips of different lengths.

6. The carrier web according to claim 2, wherein said regions of reduced adhesive strength form a pattern of dots, said pattern of dots becoming denser towards said leading edge.

7. A longitudinally extending, anti-adhesive carrier web carrying at least one self-adhesive label being releasably adhered to said carrier web with an adhesive strength, said carrier web being adapted to dispense said at least one self-adhesive label when it is advanced in a running direction of said carrier web, said at least one self-adhesive label comprising a base layer, an adhesive layer disposed at least on a part of said base layer and a plurality of edges, one of said edges being a leading edge with respect to said running direction, there being a reduction in said adhesive strength of said adhesive layer in a direction toward said leading edge, wherein said adhesive strength varies in the direction of said leading edge as a result of providing strips with adhesives of different adhesive strength.

* * * * *